US005215703A

United States Patent [19]

Bernardet

[11] Patent Number: 5,215,703

[45] Date of Patent: Jun. 1, 1993

[54] HIGH-FLUX NEUTRON GENERATOR TUBE

[75] Inventor: Henri Bernardet, St. Michel sur Orge, France

[73] Assignee: U.S. Philips Corporation, New York, N.Y.

[21] Appl. No.: 745,627

[22] Filed: Aug. 14, 1991

[30] Foreign Application Priority Data

Aug. 31, 1990 [FR] France ..... 90 10873

[51] Int. Cl.[5] ..... G21K 5/00

[52] U.S. Cl. ..... 376/114; 376/116; 376/117; 250/390.01

[58] Field of Search ..... 376/113, 114, 115, 116, 376/117; 250/390.01

[56] References Cited

U.S. PATENT DOCUMENTS

| | | | |
|---|---|---|---|
| 2,211,668 | 8/1940 | Penning | 376/113 |
| 3,609,369 | 9/1971 | Croitoru | 250/84.5 |
| 4,529,571 | 7/1985 | Bacon et al. | 376/144 |
| 4,996,017 | 2/1991 | Ethridge | 376/116 |
| 5,078,950 | 1/1992 | Bernardet | 376/116 |
| 5,104,610 | 4/1992 | Bernardet | 376/116 |
| 5,112,564 | 5/1992 | Bernardet | 376/116 |
| 5,152,956 | 10/1992 | Bernardet | 376/113 |

*Primary Examiner*—Donald P. Walsh
*Assistant Examiner*—Frederick H. Voss
*Attorney, Agent, or Firm*—Leroy Eason

[57] ABSTRACT

A neutron generator tube includes an ion source having at least one anode (6), at least one cathode (7) having at least one extraction port (12), and an accelerator electrode (2) arranged so as to project at least one ion beam from the ion source onto a target (4) to produce thereat a reaction resulting in emission of neutrons. The ion source is arranged on at least a portion of a first surface of revolution (8', 41, 51) and is constructed so as to produce emission of ions radially outwardly from such surface. The accelerator electrode (2) is arranged on at least a portion of a second surface of revolution which surrounds the aforesaid first surface, the target (4) being positioned on at least a portion of a third surface of revolution which surrounds the aforesaid second surface. Increased neutron flux is thereby achieved for a given size generator tube, and for a given neutron flux a significantly reduced ion bombardment density is produced at the target and so achieves extended target life.

20 Claims, 7 Drawing Sheets

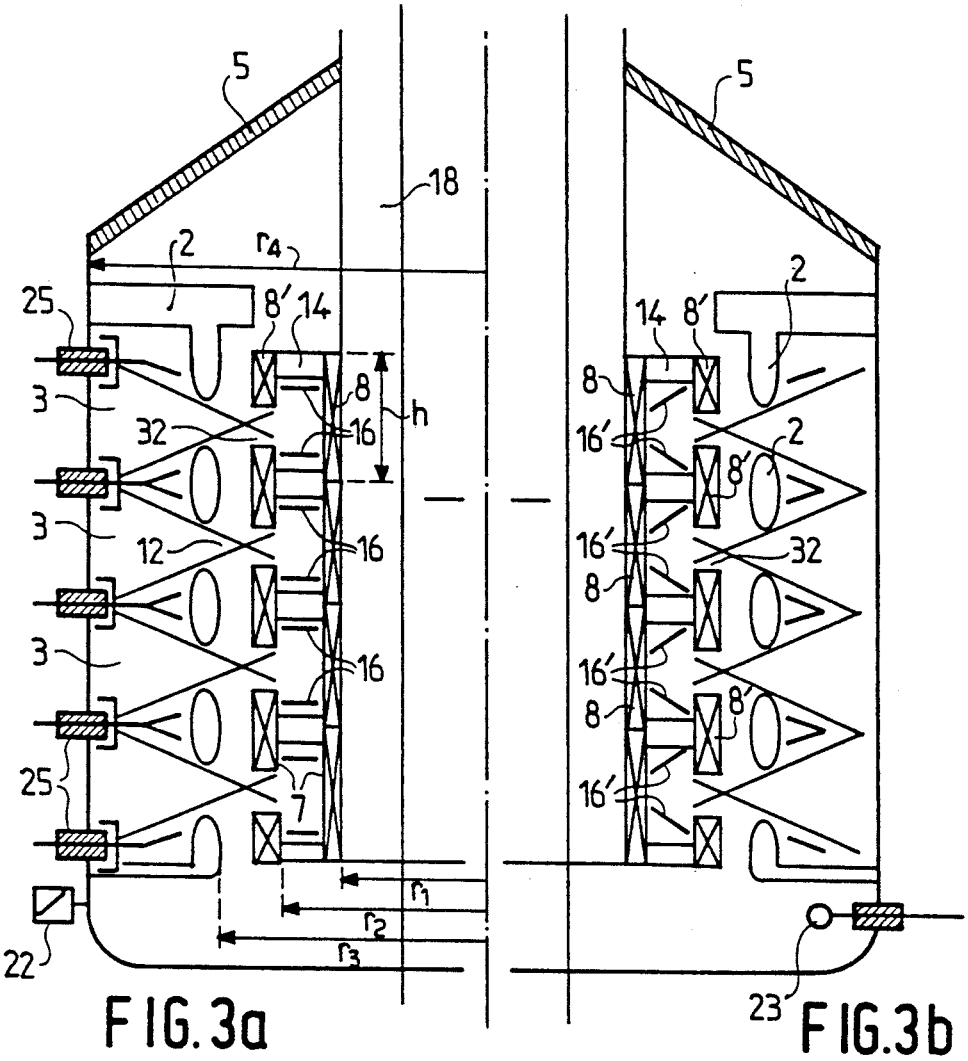
FIG.3a
FIG.3b
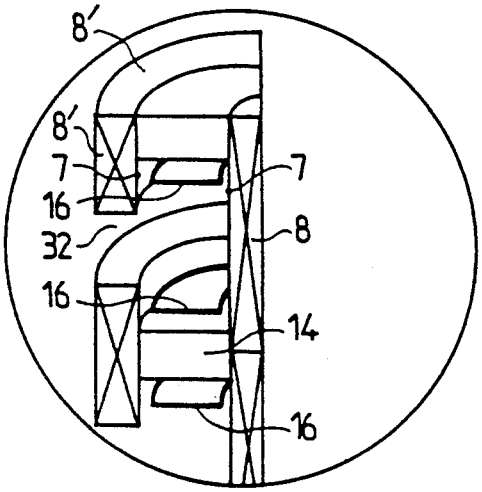
FIG.3c
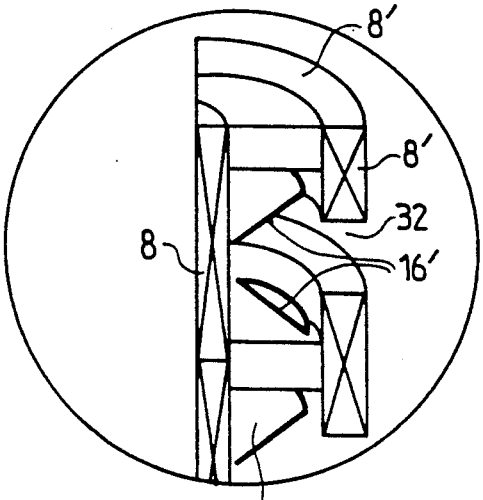
FIG.3d

HIGH-FLUX NEUTRON GENERATOR TUBE

FIELD OF THE INVENTION

The invention relates to a neutron generator tube comprising an ion source which has at least one anode and at least one cathode, with at least one extraction port, and also comprising an accelerator device disposed in such a manner as to project at least one beam of ions from the ion source onto a target for producing a reaction there which leads to an emission of neutrons.

PRIOR ART

Neutron generator tubes are usually constructed as sealed tubes containing a gas mixture of deuterium and tritium under low pressure, from which the ion source forms a confined ionized gas. The emission (or extraction) port is provided in the cathode, while the acceleration (and extraction) electrode renders it possible to project the ion beam axially onto a target electrode.

Confinement of the plasma may be obtained by means of magnetic and/or electric fields. Neutron generator tubes are used in material examination techniques by means of fast, thermal, epithermal, or cold neutrons: neutrography, activation analysis, spectrometric analysis of inelastic diffusions or radiative capture, neutron diffusion, etc.

The ion source type most widely used in the Penning type which has the advantage that it is robust, has a cold cathode (and thus a long operating life), yields considerable discharge currents at low pressures (of the order of 10 A/torr), has a high extraction efficiency (20 to 40%), and has small dimensions. This type of source requires a magnetic field of the order of a thousand gauss parallel to the axis of the ionization chamber, which introduces a considerable transverse inhomogeneity of the ion flow density in the interior of the discharge and at the level of the extraction which takes place along the common axis of the field and of the source.

The fusion reaction $d(3_H), 4_{He})n$ which supplies neutrons of 14 meV is most widely used because of its great effective sectional surface at comparatively low ion energy levels. Whatever reaction is used, however, the number of neutrons obtained per unit charge going through the beam always increases in proportion as the energy of the ions directed towards a dense target itself increases, to well beyond the ion energies obtained in presently available sealed tubes which are fed by a high tension which seldom exceeds 250 kV.

Erosion of the target by the ion bombardment is one of the most determining factors among the principal constraints governing the operating life of a neutron generator tube.

The erosion is a function of the chemical composition and the structure of the target on the one hand, and of the energy of the incident ions and their density distribution profile on the impact surface on the other hand.

In most cases the target is formed from a material capable of forming a hydride (titanium, scandium, zirconium, erbium, etc) and of binding and releasing considerable quantities of hydrogen without an inadmissible disturbance of its mechanical strength; the total quantity bound is a function of the temperature of the target and of the hydrogen pressure in the tube. The target materials used are deposited in the form of thin layers whose thickness is limited by adhesion problems of the layer on its support. A means of slowing down the erosion of the target consists, for example, in forming the active absorbing layer from a superimposition of identical layers insulated from one another by diffusion barriers. The thickness of each of the active layers is of the order of the penetration depth of the deuterium ions which are to strike the target.

Another method of protecting the target, and thus of increasing the operating life of the tube, is to influence the ion beam in such a way as to improve its density distribution profile on the impact surface. At an overall ion flow on the target which is constant, which leads to a constant neutron emission, this improvement results in a flow density distribution over the entire surface of the target exposed to the ion bombardment which is as uniform as possible.

A drawback results from the fact that the ions, which are extracted and accelerated towards the target, react with the molecules of the gas included in the tube at such a pressure, which is a constraint in the first instance, as to produce ionization, dissociation and charge exchange effects, which lead on the one hand to a decrease in the average energy on the target, i.e. a decrease in the production of neutrons, and on the other hand to the formation of ions and electrons which are subsequently accelerated and bombard the ion source or the electrodes of the tube.

The result is energy depositions which increase the temperature of the materials of the electrodes, such as molybdenum or stainless steel. The heating-up of these materials leads to the desorption of impurities, such as carbon monoxide, which they hold captive, thus disturbing the quality of the atmosphere in the tube. The impurity ions formed in the tube, $CO^+$ for example, bombard the target with a pulverising coefficient which is higher than that of the deuterium-tritium ions by a factor $10^2$ to $10^3$, thus causing a considerable increase in erosion. These effects increase with the operating pressure in the neutron generator tube.

These general considerations applicable to all kinds of ion sources show that obtain of a high neutron flow with long operating lives (for example, several thousands of hours) it is necessary to use:

targets with large surface areas, ion bombardment densities on the targets which can be combined with an effective cooling and a low pulverisation, reduced operating pressures which in turn render it necessary to use ion sources with a high ion producing efficacy.

To illustrate this, an average bombardment density of 0.5 mA with a maximum of the order of 1 mA should render it possible to exceed one thousand hours of operation; as for the neutron level, for an acceleration voltage of 250 kV, this will be approximately $3.10^{10} n/cm^2.s$ for neutrons of 14 MeV. To obtain a level of $10^{13}$ n/s, a target surface of 300 $cm^2$ would be necessary, and for $10^{14}$ n/s a target of 3000 $cm^2$.

Other known types of ion sources with an electrostatic confinement of the ions, such as described in the French Patent Application no. 88 13188 filed by Applicant on Oct. 7th, 1988 and published under no. FR 26 37 727 discloses similar characteristics as regards the wear of the target.

French Patent Application no. 88 13187 filed by Applicant on Oct. 7th, 1988 and published under no. FR 26 37 726 in addition discloses an ion source of the multicell type which has a Penning cell comprising an anode with a plurality of holes disposed at the interior of the cathode cavity so as to increase the ion flow. It is also possible to obtain a higher flow homogeneity on a target of greater dimensions, but the emission levels as mentioned above would still require prohibitive dimensions.

SUMMARY OF THE INVENTION

An object of the invention is to realise an ion extraction which on the one hand is no longer axial but radial, based on the recognition that this renders possible a reduction of the electric fields producing the cold emission of the electrodes and of the number of breakdowns, thanks to an asymmetry in the distribution of the electric field, and which on the other hand leads to the possibility of arranging the target cylindrically around the ion source, from which results a very considerable increase in the overall dimensions of a high-flux neutron source.

A neutron generator tube according to the invention is therefore characterized in that the ion source is arranged in at least a portion of a first surface of revolution and constructed so as to produce emission of ions in radial direction towards the exterior of the said first surface, in that the accelerator device is arranged in at least a portion of a second surface of revolution surrounding the said first surface, and in that the target is arranged in at least a portion of a third surface of revolution surrounding the said second surface.

It will be noted in addition about such an ion source that the radial extraction method towards the exterior suppresses in part the sheathing effect caused by the perimeter of the extraction electrode, leading to an increase in the extraction efficiency of the source, all other factors being equal.

The tube according to the invention may comprise a suppression device for secondary electrons, which is known per se, arranged in at least a portion of a fourth surface of revolution situated between the second and the third surface.

The accelerator device may advantageously be a cylindrical electrode.

According to a first embodiment using magnetic confinement, the ion source is formed by at least one elementary source of the Penning structure, which in particular may comprise a plurality of elementary sources arranged in at least portions of superimposed rings. In an advantageous form of this embodiment, the first surface of the revolution is a first cylinder and comprises a first cylindrical magnet arranged on the minor radius of first cylinder and at least one second cylindrical magnet enclosed in the said cathode on the major radius of the first cylinder in such a way as to produce a radial magnetic field.

The anode may be cylindrical or have the shape of a truncated cone. It is preferably formed by two parallel discs or two discs or truncated-cone shape, which renders it possible to realise one single anode for each ring, which simplifies the construction. The extraction port may be an annular slot, which is favourable for the extraction efficiency.

According to a second embodiment also using magnetic confinement, the ion source is formed by a structure of the inverted magnetron type. Such a structure is generally used only as a measuring instrument (ionization gauge). In this connection, reference is made to the book *The Physical Basis of Ultrahigh Vacuum* (Redhead et. al., National Research Council Ottawa, CDN, published by Chapman and Hall Ltd, London (UK), pp. 333 and 334). Such a device is here used as an ion source with the use of at least one extraction port in the cathode. At least one anode may be annular. A third annular magnet may be arranged in such a way as to produce a longitudinal magnetic field. The magnetic field may be obtained by to a solenoid surrounding the third (or, as the case may be, the fourth) cylindrical surface and arranged in such a way as to produce a longitudinal magnetic field. In that case, and according to a preferred embodiment of the invention, a cylindrical anode may be disposed on the minor radius of the first cylinder, extending substantially over the height of the first cylinder. It is thus possible to obtain with a single anode and a single cathode an emission on a surface of revolution, notably cylindrical, of considerable length.

According to a third embodiment using electrostatic confinement, the ion source is of the orbitron type comprising a second cylindrical anode disposed on the minor radius of the first cylinder and extending substantially over the height of the said first cylinder. The ion source may in addition comprise a hot cathode.

According to a fourth embodiment also using electrostatic confinement, the ion source is of the electrostatic Reflex type (SIRE) and comprises at least one annular anode, or, advantageously, a multi-annular electrode.

BRIEF DESCRIPTION OF THE DRAWINGS

The invention will be better understood through perusal of the following description, which is given by way of non-limitative example, with reference to the drawings in which:

FIGS. 3*a* and 3*b* show, in a similar cylindrical structure, two preferred modifications of a Penning source tube with radial extraction according to the invention, FIGS. 3*c* and 3*d* being details of FIGS. 3*a* and 3*b*, while

DESCRIPTION OF THE PREFERRED EMBODIMENTS

Figure 1:
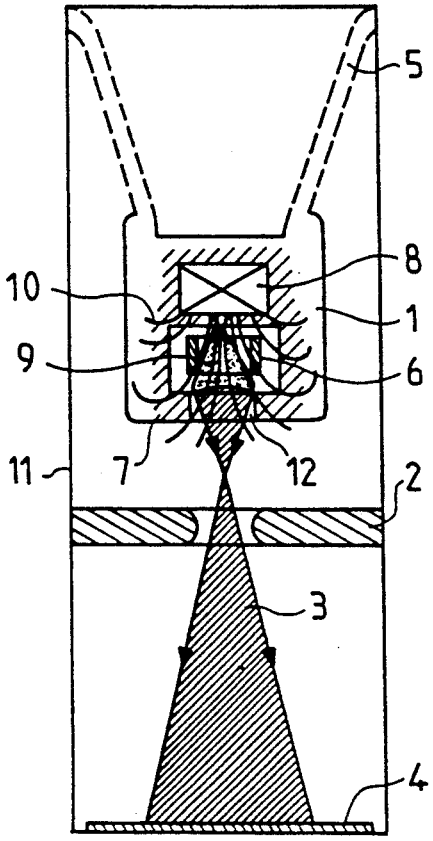
FIG. 1 shows a neutron generator tube with axial extraction of the Penning type according to the prior art (French Patent Application No. 88 13186, filed by Applicant on Oct. 7, 1988, and published under No. FR 2637725).

The drawing of FIG. 1 shows the principal base elements of a sealed neutron generator tube 11 enclosing a gas mixture at low pressure which is to be ionized, such as deuterium-tritium, and comprising an ion source 1 and an accelerator electrode 2 between which a very high potential difference exists so as to permit of the extraction and focusing of the beam of ions 3 and its projection onto the target 4, where a fusion reaction takes place leading to an emission of neutrons at, for example, 14 MeV.

The ion source 1 integral with an insulator 5, which renders it possible for a high-voltage, for example 250 kV, supply connector (not shown) to pass, is a source of the Penning type, for example, formed by a cylindrical anode 6, a cathode structure 7 with which is incorporated a magnet 8 with an axial magnetic field which confines the ionized gas 9 to the surroundings of the axis of the anode cylinder and whose lines of force 10 show a certain divergence. An ion emission channel 12 is provided in the said cathode structure opposite the anode.

The anode is brought to a potential higher by several (1 to 6, for example) kV than that of the cathode, which itself is brought to the said high supply voltage. The accelerator electrode 2 and the target 4 are usually at ground potential.

Figure 2A:
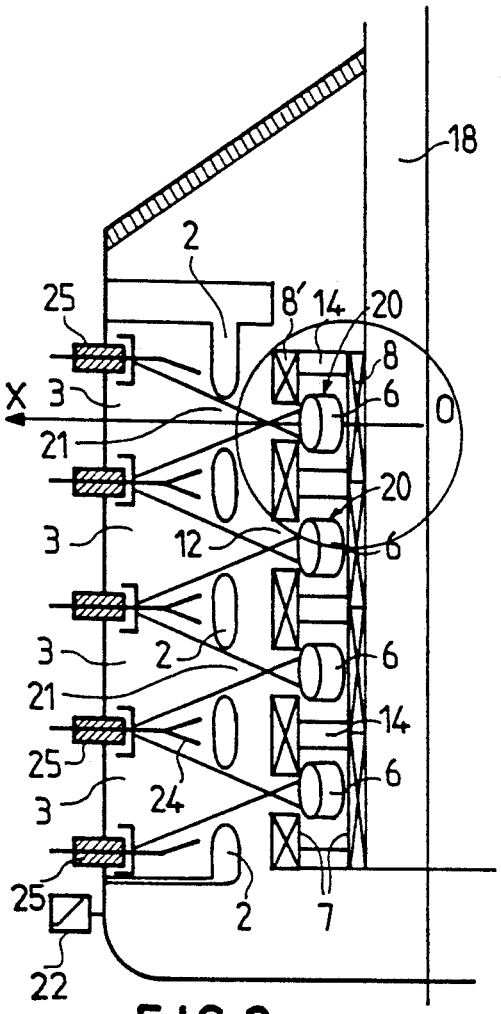
FIGS. 2*a* and 2*b* show, in a similar cylindrical structure, two modifications of a tube with Penning-type ion source with radial extraction according to the invention, FIGS. 2*c* and 2*d* being details of FIGS. 2*a* and 2*b*.
Figure 2B:
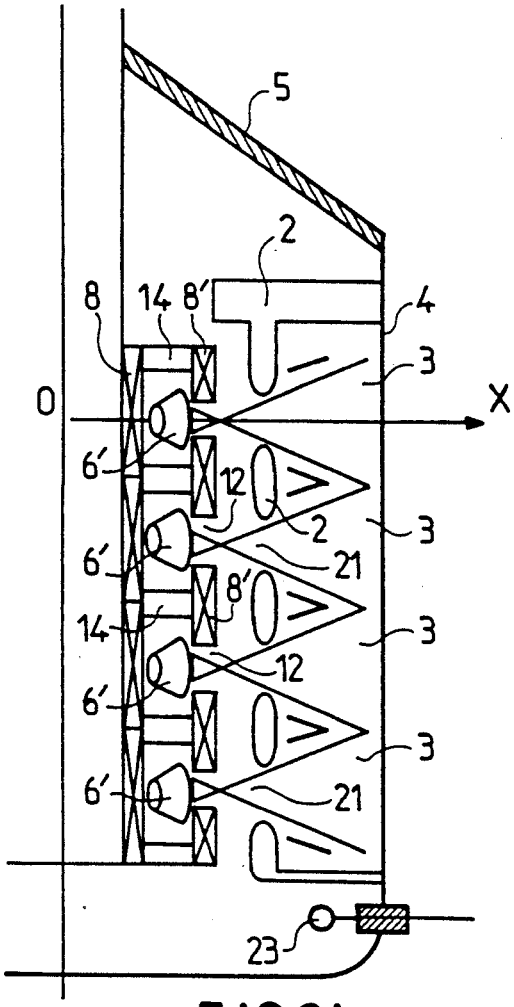
Figure 2C:
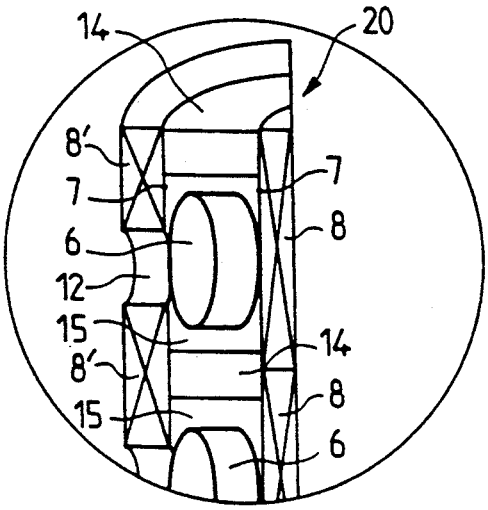

As shown in FIGS. 2*a* and 2*c*, a neutron generator tube according to the invention provides ion emission and extraction in radial directions. The ion source is formed by a plurality of sources of the Penning type arranged in cylindrical symmetry (as shown), or, alternatively, in conical arrangement. In order to achieve this, it has an annular structure, or, alternatively, a plurality of superimposed annular structures 20 (all being of the same cross-section in the case of cylindrical symmetry). Each annular structure 20, which is mechanically fixed on a central shaft 18 brought to a high voltage (200 to 250 kV) comprises a cylindrical magnet 8 on the minor radius of the annular structure 20, a flat ring 14, and a cylindrical portion 8' disposed on the major radius of the annular structure 20. The flat ring 14 forms a part of the metal structure now integral with the cylindrical magnet 8 and the cylindrical portion 8', which itself may be formed by a cylindrical magnet enclosed in the cathode structure 7. The cathode 7 is then formed by the internal cylindrical surfaces corresponding on the one hand to the interior minor radius and on the other hand to the exterior, major radius. The cylindrical magnet 8 has a height which is at least equal to that of the cathode 7. The flat ring, which has to serve as a magnetic circuit is accordingly itself made of magnetic material (soft iron or magnetic alloy, for example).

A plurality of cylindrical anodes 6 are radially distributed over the circumference of the annular structure 20, having substantially the same axis as the extraction openings 12 provided in the cylindrical portion 8' of the cathode structure 7. An accelerator electrode 2 takes the form of a cylinder (or of a cone) having acceleration openings 21 situated opposite the openings 12. The target comprises a cylindrical (or conical) support 4 to which the accelerator electrode 2 may be mechanically and electrically connected. A high-voltage insulator of truncated cone shape 5 mechanically holds the assembly together. The ion source may be so arranged that the emission takes place over the entire circumference or only over a portion or sector thereof. To achieve this, the ring may extend over 360° or merely over a smaller angle, comprising openings 12 at useful locations only. The openings 12 of two superimposed rings may be angularly offset, for example, to obtain a greater homogeneity of the beam on the target. A reservoir of deuterium-tritium has reference numeral 23, while 22 indicates a pressure gauge. Electrodes 24 for suppressing secondary electrons are arranged in the intermediate planes between the rings outside the ion beams 3. Insulating leadthroughs 25 distributed over the circumference render possible their mechanical fixation and/or their electrical supply. The electrodes 24 are brought to a negative potential (for example, −5 kV) relative to those of the accelerator electrode 2 and of the target 4 connected to mass, and are advantageously manufactured from a refractory material. For more information, reference can be made to the above cited FR 2 637 725. The electrodes 24 are preferably toric in cross-section taken on V so as the better to fit the profile of the ion beams 3.

Figure 2D:
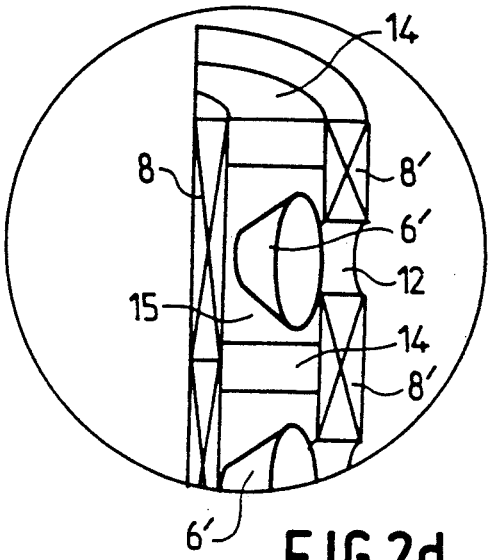

In FIGS. 2*b* and 2*d*, the anodes 6' are conical instead of cylindrical. These two modifications have been shown on a similar cylindrical structure, for greater convenience. More information on this anode shape will be found in the French Patent Application No. 88 13185, deposited on Oct. 7th, 1988 by applicant and published under no. FR 2 637 724.

FIGS. 3*a* to 3*d* show a second structure embodiment with the ion source of the Penning type. Therein in that the n modules of cylindrical (or conical) ion sources are integrated in an annular structure having an adjacent electrical layout, while the distribution of the magnetic field is similar to the preceding one. To achieve this, the anode of the structure is formed by two parallel discs 16, or mutually inclined discs 16', so as to be in better accord with the lines of force of the magnetic field. The cathode 7 of the structure is formed by the internal cylindrical surfaces corresponding on the one hand to the minor, interior radius and on the other hand to the major, exterior radius, the latter surface being pierced over its entire length with an extraction slot 32 of a height and depth coordinated in such a way as to prevent the excessive penetration of the electric field applied by the accelerator electrode. As in a classical Penning structure, the magnetic field in the interior of the structure must be stronger than the critical field (a value connected on the one hand with the geometric structure: the distance between the two anode rings and to a lesser degree with the distance between the cathodes, and on the other hand with the voltage applied between anode and cathode), i.e. than the magnetic field which prevents the electrons from reaching the anode on the basis of oscillations without ionization collision.

The magnets used for producing this magnetic field are formed, as above, by rings divided into two assemblies held together mechanically by metal frames 14 which serve as a magnetic circuit (magnetic material). The first assembly is formed by two rings 8' arranged on either side of the extraction slot. The second magnet is formed by a cylinder 8 whose thickness is a function of the magnetic field necessary for good operation of the source and of the nature of the material used. Its height is at least equal to the height of the cathode 7.

Figure 3E:
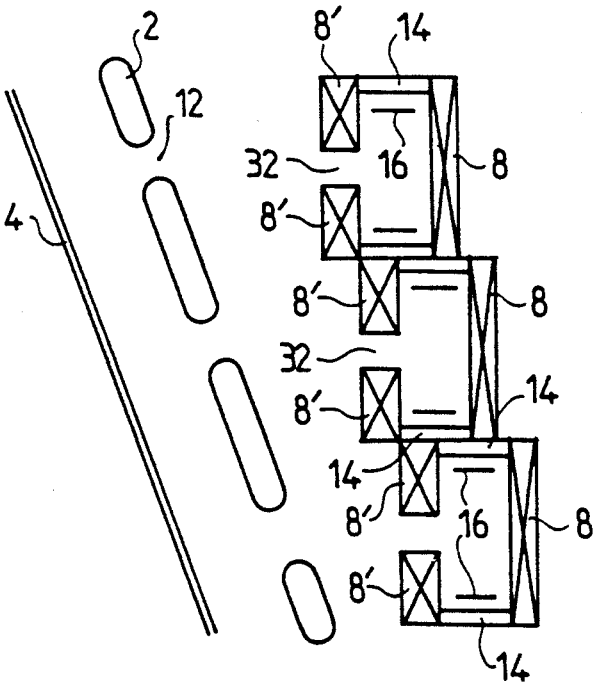
FIG. 3*e* is a modification of FIG. 3*a* corresponding to a truncated-cone emission.

As FIG. 3*b* shows, annular structures corresponding to those of FIG. 3*a*, but having different radiuses, are arranged on top of one another so as to form a truncated cone structure. The accelerator electrode 2 and the target 4 may also be truncated.

In the case of FIG. 3*a*, the following values may obtain $r_1=4$ cm, $r_2=7$ cm, $r_3=10{,}5$ cm, $r_4=15$ cm; thickness of magnet 8: 1 cm; thickness of magnet 8': 1.5 cm; height of a ring $h=6$ cm.

Figure 4A:
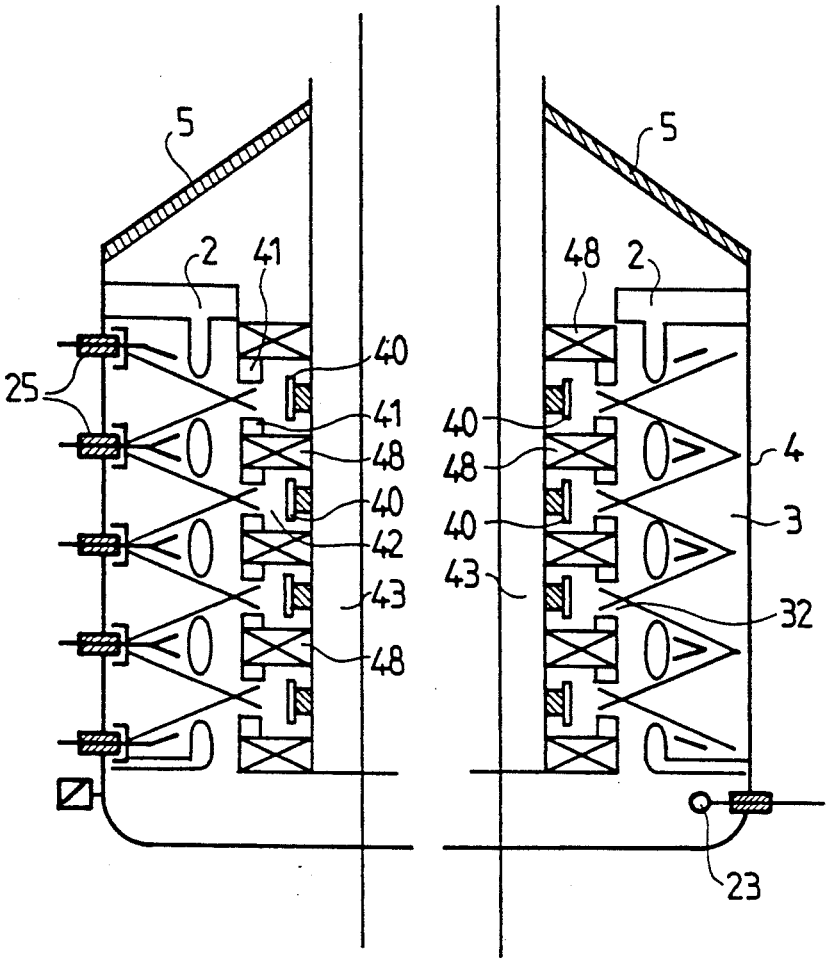
FIG. 4 shows a first modification of a tube with an ion source of the inverted magnetron type with radial extraction according to the invention, FIG. 4*b* depicting the path of ionizing electrons in such an ion source.
Figure 4B:
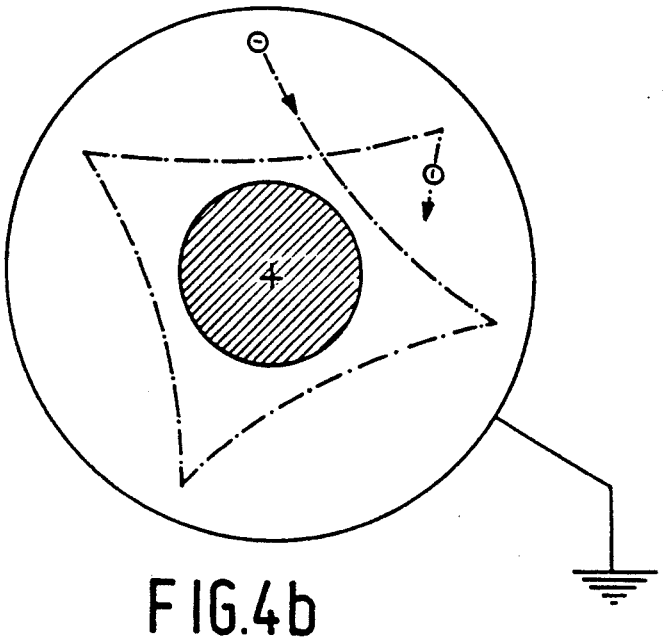

According to FIGS. 4*a* and 4*b*, the ion source is realised in a so-called "inverted magnetron" structure, which is known from its use in an ionization gauge (Redhead et. al., cited above). The dimensions are practically identical to those of the Penning structure, as are the pressure and the operating voltages.

In this structure (FIG. 4*a*), the anode is formed by a ring 40 (for example, with a height of 3 cm and a radius of 5 cm) situated in the interior of the cathode cavity 42 of which the principal element is formed by the cylindrical cathode wall 41 divided into two portions by the extraction slot 32. The height of an elementary cell may be, for example, 6 to 8 cm. The electric field in this zone is radial and the magnetic confinement field is roughly perpendicular thereto, and consequently parallel to the axis of symmetry of the structure. The electrons which are accelerated towards the anode are deflected towards the cathode by the magnetic field and describe cycloids (FIG. 4*b*) having the cylindrical surface (or the equipotential surface) for their base on which they are formed.

The magnetic confinement field may be created by the magnets 48 which are of disc shape and are arranged symmetrically relative to the plane of symmetry of the structure; these magnets 48 may be mechanically held on a metal support 43 which acts as a magnetic circuit and whose diameter is smaller than the anode diameter. The confinement field may alternatively be created (FIGS. 5 and 6) by a coil 50 arranged outside the tubular structure and leading to the creation of a magnetic field stronger than the critical field. The coil 50 has a height which may advantageously be 1.5 to 2 times the overall height of the cathode structures. This configuration may be interesting in certain applications, necessitating braking of neutrons, the use of a heavy coiling material cooled by circulation of water which may simultaneously serve to cool the target. In this configuration, it is an important advantage that the secondary electrons of the target are trapped (return to the target 4) by the magnetic field, and the suppression electrode 24 is not strictly necessary during low-pressure operation (approximately $10^{-4}$ to $10^{-2}$ Torr). In the case shown in FIGS. 5 and 6, the anodes may be formed (FIG. 5) by a ring 40 arranged in each cathode cavity 42 bounded by flat rings 52 of conductive material, while the cathode is formed by conductive rings 51 (for example, 3 to 4 cm high) integral with the flat rings 52 (for example, 2 mm high), between which the extraction slots 32 are situated. The anode is preferably formed (FIG. 6) by a single cylinder (or truncated cone) 55 fixed by means of ribs 56, the flat rings 52 being left out.

The structures described below comprise an ion source with radial extraction according to the invention with an electrical confinement field.

Figure 7:
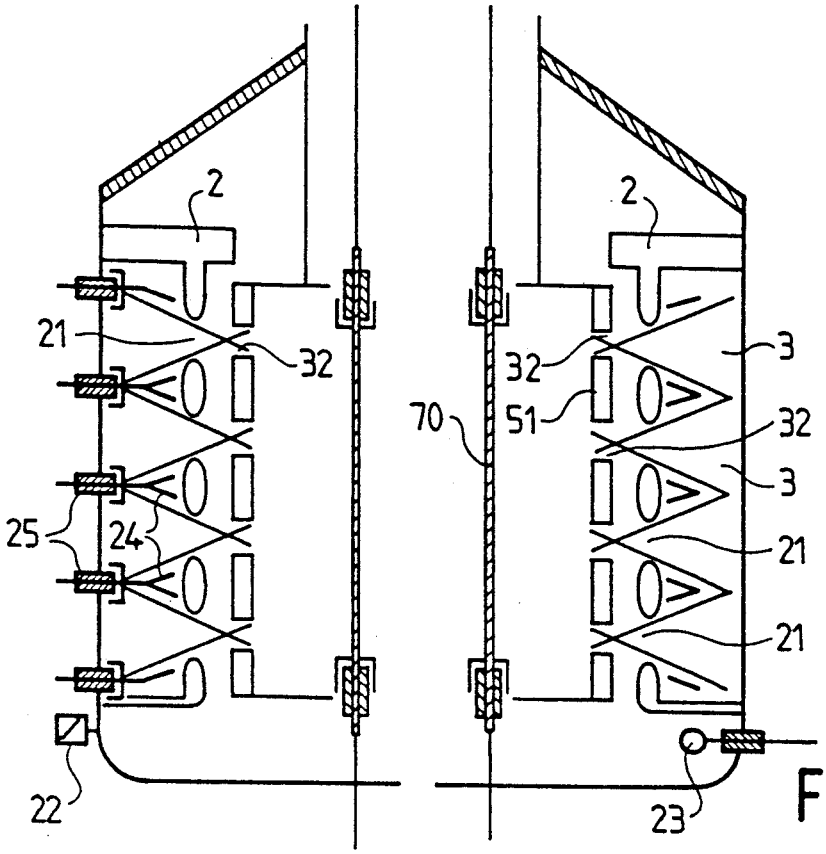
FIGS. 7 and 8 show two modifications of a tube with an ion source of the orbitron type with radial extraction according to the invention.
Figure 8:
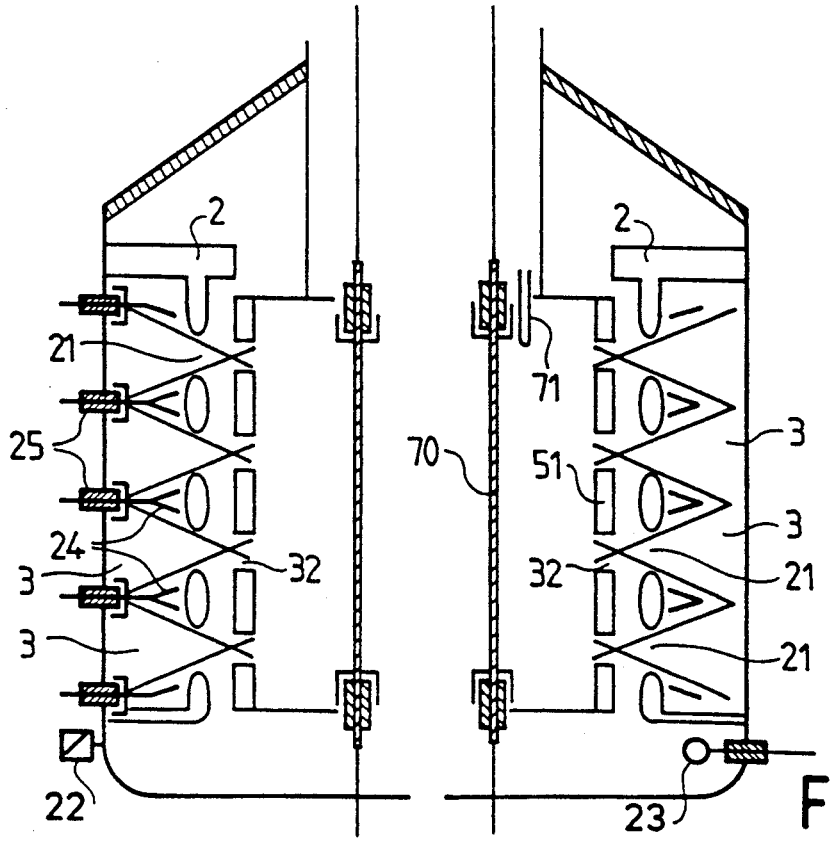

FIGS. 7 and 8 show an orbitron structure comprising an anode 70 of small dimensions (for example, diameter lying between 0.05 and 0.1 cm) situated on the axis of the cathode 51 (for example, of between 10 and 15 cm diameter). This structure may have a cold cathode (FIG. 7) and consequently require a high anode voltage and an operating pressure lying at least in a range of $10^{-4}$-$10^{-3}$ Torr, or alternatively have a hot cathode 71 (FIG. 8), which then extends the operating range further towards the lower pressures. The operating principle is as follows: the electrons emitted by the filaments or the cathodes are attracted by the anode; subject to their emission angles and their initial energies, they may "miss" the anode and thus oscillate in the interior of the structure for a longer period, by which the ionization probability is strongly increased and a discharge with the formation of a plasma is created. The ions are attracted onto the cathode and their extraction is effected through one or several cylindrical slots 32. The extraction and the position of the slots 32 may be realised in a manner similar to the inverted magnetron structure with solenoid. The accelerator structure 2 and the suppression structure 24 for the secondary electrons of the target are similar to those of the systems having an ion source with a magnetic confinement field. The shape and position of the suppression electrode 24 may be such as to take into account higher operating pressures, in accordance with structures disclosed in the cited French Patent no. 88 13186.

Figure 9:
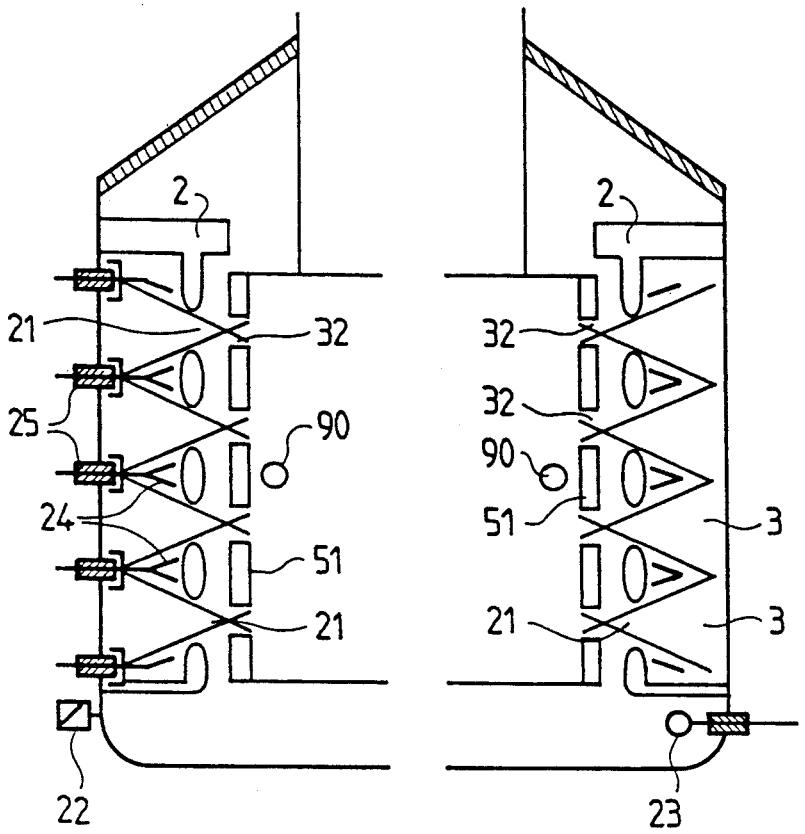
FIGS. 9 and 10 show two modifications of a tube with an ion source of the electrostatic Reflex type with radial extraction according to the invention.
Figure 10:
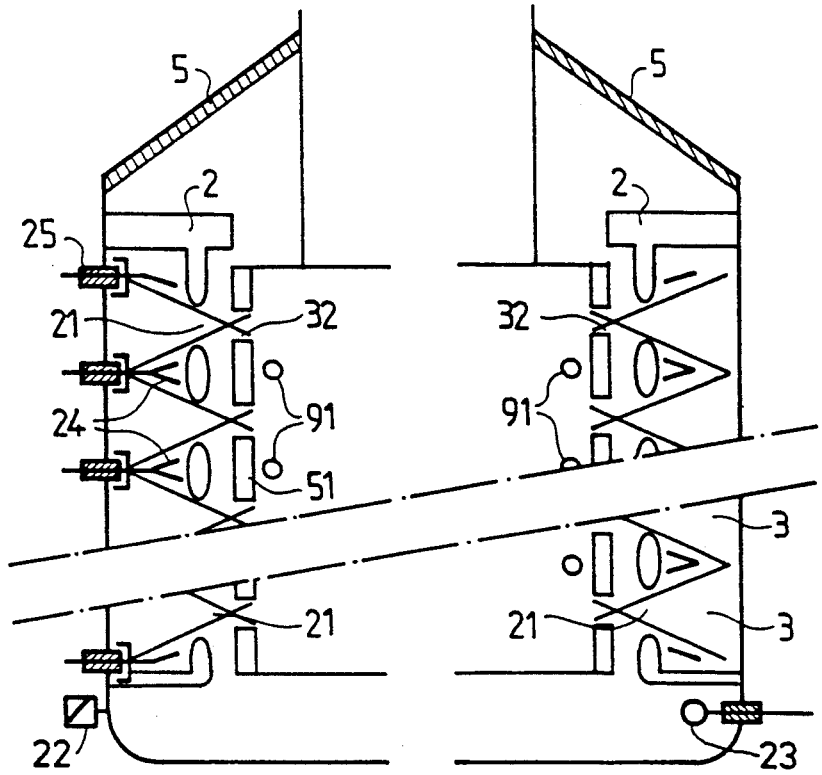

FIGS. 9 and 10 show electrostatic reflex structures (SIRE) with cold cathodes. The anode 90 is close to the cylindrical cathode 51 (cathode diameter, for example, lying between 2 and 3 cm), and the electrons oscillate between the two plane sections of the cathode; the ion flow density is much greater on the two plane portions of the cathode, particularly at low pressure (for example, $10^{-3}$ Torr). The radial extraction takes place through cylindrical slots 32 provided in the cylindrical wall of the cathode 51 under similar conditions to those in the inverted magnetron structure. Their relative surface area (relative to the total surface of the cylindrical portion of the cathode) may be considerable since the major portion of the discharge is caused by the plane sections. The number of slots is a function of the height of the ion source structure and its dimensions. The number of annular anodes (circular or cylindrical section), cooled or not, and arranged in the intermediate region between the extraction surfaces is a function of the height of the structure. FIG. 9 shows a structure with four extraction "rings", while FIG. 10 shows a neutron generator tube which is much higher with N extraction structures ($N>4$). In the latter case, an anode having several rings 91 is used. The accelerator portion 2 and the secondary-electron suppressors 24 are similar to those in the structures with magnetic fields. The diameter of the SIRE structure may be of the order of 10 to 15 cm. Their operating pressures are generally between $10^{-3}$ Torr and a few $10^{-2}$ Torr, and their voltages between a few kV and 12 kV.

A substantial increase in the neutron emission combined with a relatively much smaller increase in the volume may be obtained through the arrangement of several similar structures along the same axis, as is shown in FIGS. 2*a* to 2*d*, 3*a* to 3*d*, 4*a*, 5, 9 and 10. In fact, the electrically insulating portions, and possibly the magnetic supports remain the same, only the active parts consisting of the electrodes and (possibly) the magnets are multiplied. The stacking may be realised in that cylinders or truncated cones are formed. The following solutions may be suggested by way of example.

Penning-type ion source structure: the magnetic circuits in the form of rings are common to two consecutive structures, and each structure has its own magnets (FIGS. 2*a* to 2*d*, 3*a* to 3*d*).

Ion source structure of the inverted magnetron type with magnets: two consecutive structures have the same magnets 48, and the magnetic circuits 41 are stacked on one another and consequently unique to each structure (FIG. 4*a*).

Figure 5:
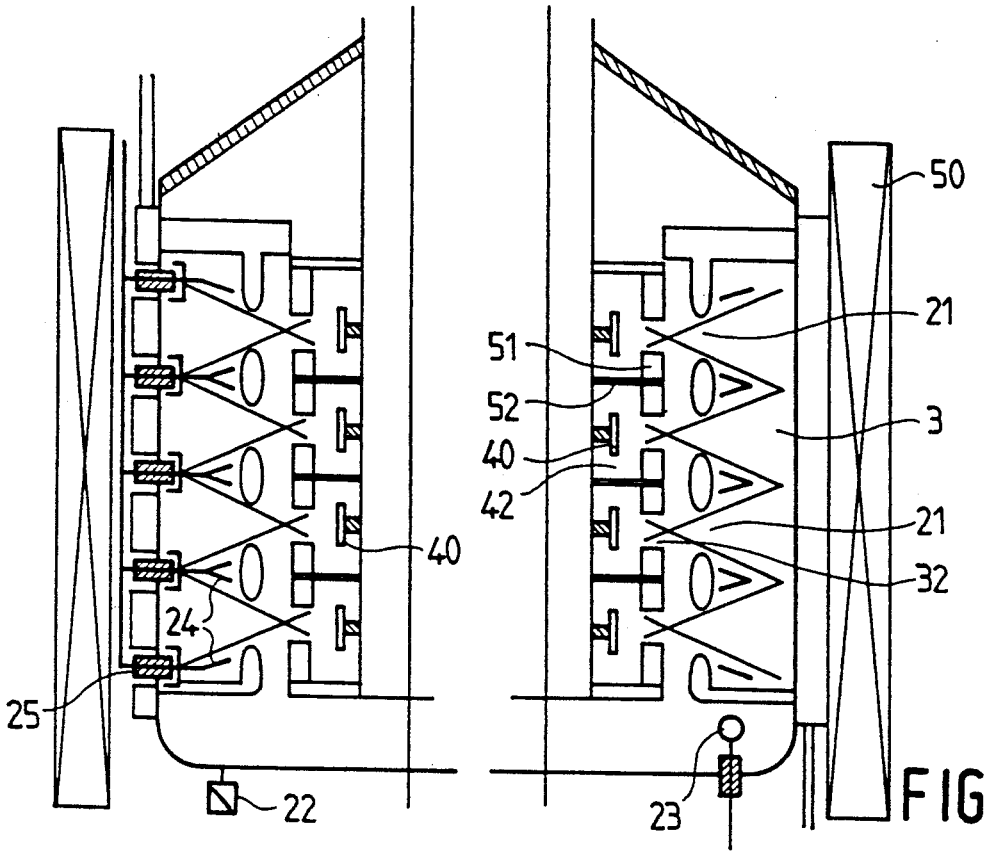
FIGS. 5 and 6 show two modifications of a tube of the inverted magnetron source type with radial extraction according to the invention, with a magnet or solenoid.
Figure 6:
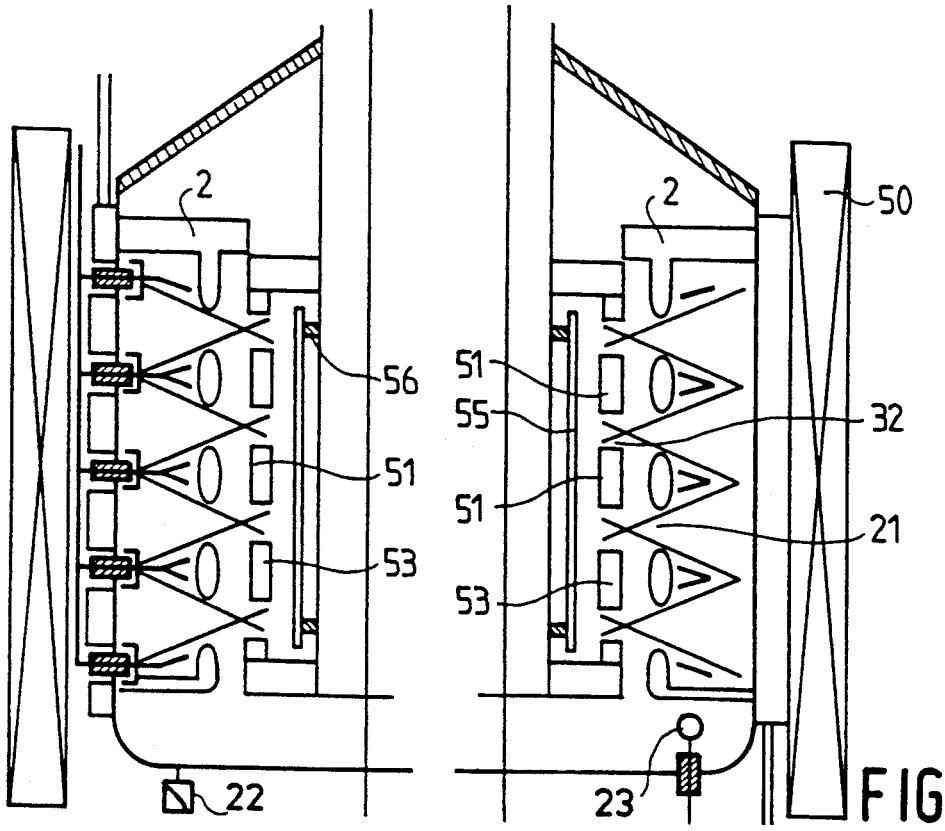

Ion source structure of the inverted magnetron type with external coil: the external coil 50 is longer than the ion source structures stacked on one another. The winding density per unit length is approximately constant (FIG. 5).

As for the electrostatic structures, their greater volume and their typical configuration allows the arrangement of only a limited number of complementary cells, in view of the fact that the dimensions of the tube are close to those of the structures with magnetic fields and that the electrostatic structures are provided with several extraction slots. It is also advantageous to modify the structures themselves (position and number of anodes in the SIRE structure, height of the cylindrical cathodes in the SIRE and orbitron structures).

All the structures described and depicted offer the advantages of radial extraction. Since the extraction takes place over a cylindrical (or truncated cone) surface, the structures benefit from an increase in the bombarded surface area (target 4) corresponding to the ratio of the radiuses of the target 4 to the extraction electrode (8', 41), independently of the effect of divergence of the ion beam. As for the source of ions itself, the radial extraction, particularly through a cylindrical slot 32, suppresses in part the sheathing effect caused by the perimeter of the extraction electrode (i.e. the portion of the cathode where the extraction takes place) and leads to an increase in the extraction efficiency of the source, all other factors being equal.

A second advantage of the radial extraction structures is that they lead to a reduction in the electric fields which produce cold emission of the electrodes and in the number of breakdowns resulting therefrom, thanks to an asymmetry in the distribution of the electric field: for a distance between two electrodes, the average electric field applied varies as 1/r:

inner electrode (extraction electrode 8', 41)

$$E_{ex} = k\frac{V}{r_{ex}}$$

outer electrode (acceleration electrode 2)

$$E_{acc} = k'\frac{V}{r_{ex} + d}$$

$E_{ex}$=extraction field;
$E_{acc}$=acceleration field;
$r_{ex}$=extraction radius;
d=acceleration distance;
k and k' are constants.

Thus for acceleration distances d of the order of 20 mm and extraction electrodes with a radius $r_{ex}$ of 150 mm, the approximate variation of the electric field in the case of a classical structure (plane and parallel electrodes) will be of the order of 5 to 10%. This small deviation corresponds to a decrease in the cold emission current of the order of 5 to 10 in relation to an axial emission.

The invention is not limited to the embodiments described and drawn. It also applies, for example, to neutron generator tubes with a deuterium atmosphere only (production of neutrons of 2.6 MeV). Moreover, a pulsed operation is possible in a manner known per se for axial emission sources after an electron source has been substituted for the ion source, or an $\alpha$ and/or $\beta$ and/or $\gamma$ emitter producing the primary electrical particles which are to initiate and maintain the discharge in the ion source.

I claim:

1. A neutron generator tube comprising an ion source and an accelerator electrode, the ion source including an anode and a cathode having an extraction port through which ions are emitted, the accelerator electrode being arranged to project a beam of ions from the ion source onto a target so as to produce a reaction thereat which results in emission of neutrons; characterized in that:

the ion source is arranged on at least a portion of a first surface of revolution, and is constructed to produce ion emission radially outward from said first surface;

the accelerator device is arranged on at least a portion of a second surface of revolution which surrounds said first surface, and is constructed so that ions from said first surface are accelerated radially outward from said second surface; and the target is arranged on at least a portion of a third surface of revolution surrounding said second surface, so that ions from said second surface are radially incident on said target.

2. A neutron generator tube as claimed in claim 1, further comprising a suppression electrode for secondary electrons, said suppression electrode being arranged on at least a portion of a fourth surface of revolution situated between said second surface and said third surface.

3. A neutron generator tube as claimed in claim 1, characterized in that said first surface of revolution is cylindrical.

4. A neutron generator tube as claimed in claim 3, characterized in that said second surface of revolution is cylindrical.

5. A neutron generator tube as claimed in claim 1, characterized in that said ion source is of the Penning type.

6. A neutron generator tube as claimed in claim 1, characterized in that said ion source comprises a plurality of elementary ion sources of the Penning type and which are arranged on at least portions of superimposed rings.

7. A neutron generator tube as claimed in claim 5, characterized in that the ion source comprises a first cylindrical magnet arranged on a minor radius of the first surface of revolution and a second cylindrical magnet enclosed in said cathode and arranged on a major radius of the first surface of revolution, said magnets being adapted to produce a radial magnetic field.

8. A neutron generator tube as claimed in claim 5, characterized in that said anode is a body of revolution of cylindrical or truncated-cone shape.

9. A neutron generator tube as claimed in claim 5, characterized in that said anode is formed by two parallel discs.

10. A neutron generator tube as claimed in claim 6, characterized in that said anode is formed by two discs of truncated-cone shape.

11. A neutron generator tube as claimed in claim 9, characterized in that at least one extraction port is an annular slot.

12. A neutron generator tube as claimed in claim 1, characterized in that the ion source is a structure of the inverted magnetron type.

13. A neutron generator tube as claimed in claim 12, characterized in that the ion source comprises an annular magnet arranged so as to produce a longitudinal magnetic field.

14. A neutron generator tube as claimed in claim 12, characterized in that said anode is annular.

15. A neutron generator tube as claimed in claim 12, characterized in that said anode comprises a solenoid of a diameter greater than that of the third surface of revolution and arranged in such a manner as to produce a longitudinal magnetic field.

16. A neutron generator tube as claimed in claim 15, characterized in that said anode is cylindrical and is disposed on the minor radius of the first surface of revolution and extending substantially over the height thereof.

17. A neutron generator tube as claimed in claim 1, characterized in that the ion source is of the orbitron type comprising a cylindrical anode disposed on the minor radius of the first surface of revolution and extending substantially over the height thereof.

18. A neutron generator tube as claimed in claim 17, characterized in that it comprises in addition a hot cathode.

19. A neutron generator tube as claimed in claim 1, characterized in that the ion source is of the electrostatic Reflex type (SIRE) having at least one annular anode and at least one extraction port which is a slot.

20. A neutron generator tube as claimed in claim 19, characterized in that it comprises a multi-annular anode.

* * * * *